United States Patent [19]

Iwamoto

[11] Patent Number: 4,774,645

[45] Date of Patent: Sep. 27, 1988

[54] REPLACEABLE LAMP BULB ASSEMBLY

[75] Inventor: Miyoshi Iwamoto, Odawara, Japan

[73] Assignee: Ichikoh Industries Limited, Tokyo, Japan

[21] Appl. No.: 122,727

[22] Filed: Nov. 18, 1987

[30] Foreign Application Priority Data

Nov. 20, 1986 [JP] Japan ..... 61-177462[U]
Nov. 20, 1986 [JP] Japan ..... 61-177463[U]
Nov. 20, 1986 [JP] Japan ..... 61-177464[U]
Nov. 20, 1986 [JP] Japan ..... 61-177465[U]

[51] Int. Cl.[4] ..... H01R 33/00

[52] U.S. Cl. ..... 362/226; 362/61; 362/80; 362/457

[58] Field of Search ..... 362/61, 80, 226, 457

[56] References Cited

U.S. PATENT DOCUMENTS 4,219,870 8/1980 Haraden ..... 362/226
4,384,319 5/1983 Blaisdell ..... 362/457
4,390,931 6/1983 Gorick ..... 362/226
4,500,946 2/1985 Mikola .

*Primary Examiner*—Douglas Hart
*Attorney, Agent, or Firm*—Foley & Lardner, Schwartz, Jeffery, Schwaab, Mack, Blumenthal & Evans

[57] ABSTRACT

A replaceable lamp bulb assembly comprises a reflector and a plug body in which a lamp bulb is secured and which is detachably mounted to the reflector. The plug body has a flange movable inside the inner circumferential surface of a socket formed on the back of the reflector. The flange has one end face thereof that is to be in contact with the outer circumferential edge of the opening formed in the apex of the reflector, and the other end face that is to be in contact with one surface of the wedge-shaped portion of the cleat. The other surface of the cleat, namely, the slanted surface thereof, is so formed as to act as wedge on the guide surface of guide member. When the plug body is fully inserted in the socket, the cleat is inserted from a direction substantially perpendicular to axial direction while the other surface of the flange is axially pressed by the wedge-shaped portions of the cleat, whereby the plug body is retained to the reflector.

9 Claims, 14 Drawing Sheets

REPLACEABLE LAMP BULB ASSEMBLY

BACKGROUND OF THE INVENTION (a) Field of the Invention:

The present invention relates to a lamp bulb assembly, and more particularly to an automotive lamp bulb assembly of which the bulb is replaceable.

(b) Related Art Statement:

A lamp bulb assembly with a lamp enclosure including a reflector has been proposed of which a plug body in which the lamp bulb is secured is removably attached to the reflector for replacement of the lamp bulb or for any other reason. A lamp bulb assembly of this kind is disclosed, for example, in the U.S. Pat. No. 4,500,946. As seen from this U.S. patent specification, the plug body in which the lamp bulb is secured has provided thereon a radially extending flange which is so formed as to be fixed, when axially forced by a locking collar, into an outer open end of a socket provided as extended axially at the back of the reflector. Three thread paths are formed circumferentially on the outer surface of the socket, and three notched passages are formed in the flange correspondingly to the thread paths. Further, there is formed on the front end of inner circumference of the locking collar a plurality of thread path following elements which can pass through the notched passages and the open ends of the thread paths when the plug is inserted into the socket. Also, there are provided on the rear end of the locking collar several compression tabs which press the flange to the socket when the locking collar is completely threaded. When attaching such plug into the socket, first the plug is inserted into the socket to a position where the flange touches the outer open end of the socket, and the notched passages are positioned so as to coincide with the thread path openings of the socket. Next, the locking collar is fitted onto the plug body, and the thread path following elements are positioned opposite to the notched passages and thread path openings. Thereafter, as the locking collar is turned clockwise while being axially pressed, the thread path following elements are engaged on the closed ends of the thread paths. As the result, the flange is rigidly pressed to the outer open end of the socket under the resilience of the compression tabs of the locking collar and the lamp bulb is retained in a pre- determined position with respect to the reflector.

However, such conventional lamp bulb assembly is disadvantageous in that the structure to attach the plug body to the socket is complicated and that the attaching procedure is tiresome because it is necessary to position the thread path openings of the socket, notched passages of the flange and the thread path following elements of the locking collar so as to be aligned with each other.

SUMMARY OF THE INVENTION

The present invention has a primary object to overcome the above-mentioned drawbacks of the conventional techniques by providing a lamp bulb assembly of which the structure is simple and in which the plug body in which the lamp bulb is secured can be easily attached and removed with respect to the reflector.

The present invention has another object to provide a lamp bulb assembly of which the plug body in which the lamp bulb is secured can be easily attached and removed with respect to the reflector and can be rigidly retained to the reflector as well.

The present invention has a still another object to provide a lamp bulb assembly which is provided with a locking means of preventing the cleat, which retains fixedly the plug body to the reflector, from being coming off the socket.

The present invention has a yet another object to provide a lamp bulb assembly in which the cleat has formed in the wedge-shaped portion thereof a hollow portion to accomodate dimensional nonuniformity of the parts.

These and other objects and advantages of the present invention will be better understood from the ensuing description made by way of example of the embodiments of the present invention with reference to the drawings.

BRIEF DESCRIPTION OF THE DRAWINGS

FIGS. 1 thru 8 show a first embodiment of the lamp bulb assembly according to the present invention, of which:

FIG. 1 is a schematic exploded perspective view of the lamp bulb assembly with the reflector partially omitted;

FIG. 2 is a cross-sectional view showing the lamp bulb assembly in a state where the plug body is attached to the reflector, with a portion of the reflector omitted and the plug body and lamp bulb not shown as cross-sectional view;

FIG. 3 is a rear view of the essential part showing the lamp bulb assembly in a state where the plug body is attached to the reflector with a portion of the reflector omitted;

FIG. 4 is a longitudinal-sectional view showing the lamp bulb assembly in a state where the plug body is attached to the reflector with the cleat, plug body and bulb not shown as sectional view;

FIG. 5 is a sectional view of the main portion of the reflector in FIG. 2 with the plug body not attached;

FIG. 6 is a sectional view of the main portion of the reflector in FIG. 4 with the plug body not attached;

FIG. 7 is a side elevation, enlarged in scale, of the cleat;

FIG. 8 is a rear view, enlarged in scale, of the cleat;

FIGS. 9 to 13 show a second embodiment of the lamp bulb assembly according to the present invention, of which:

FIG. 9 is a schematic exploded view of the lamp bulb assembly of a portion of the reflector omitted;

FIG. 10 is a rear view of the essential portion showing the lamp bulb assembly in a state where the plug body is attached to the reflector, with a portion of the reflector omitted;

FIG. 11 is a longitudinal-sectional view showing the lamp bulb assembly in a state where the cleat provided with a locking mechanism secures the plug body, with the plug body and lamp bulb not shown as sectional view;

FIG. 12 is a side elevation, enlarged in scale, of the clear provided with a locking mechanism;

FIG. 13 is a rear view, enlarged in scale, of the cleat;

FIGS. 14 to 16 show a variant of the cleat provided with a locking mechanism, of which:

FIG. 14 is a perspective view, enlarged in scale, of the cleat;

FIG. 15 is a rear view showing the essential portion of the lamp bulb assembly in a state where the plug body is attached by the cleat to the reflector, with a portion of the reflector omitted;

FIG. 16 is a longitudinal-sectional view showing the lamp bulb assembly in a state where the clear with locking mechanism secures the plug body, with the plug body and lamp bulb not shown as sectional view;

FIGS. 17 to 22 show a third embodiment of the lamp bulb assembly according to the present invention, of which:

FIG. 17 is a schematic exploded view of the lamp bulb assembly, with a portion of the reflector omitted;

FIG. 18 is a rear view showing the essential portion of the lamp bulb assembly in a state where the plug body is secured by the cleat to the reflector which is shown as partially omitted;

FIG. 19 is a longitudinal-sectional view showing the lamp bulb assembly in a state where the cleat secures the plug body, with a portion of the reflector omitted and with the plug body and lamp bulb not shown as sectional view;

FIG. 20 is a cross-sectional view showing the lamp bulb assembly in a state where the cleat secures the plug body, with a portion of the reflector omitted and with the plug body and lamp bulb not shown as sectional view;

FIG. 21 is a side elevation of the cleat;

FIG. 22 is a rear view of the cleat;

DETAILED DESCRIPTION OF THE PREFERRED EMBODIMENTS

Figure 1:
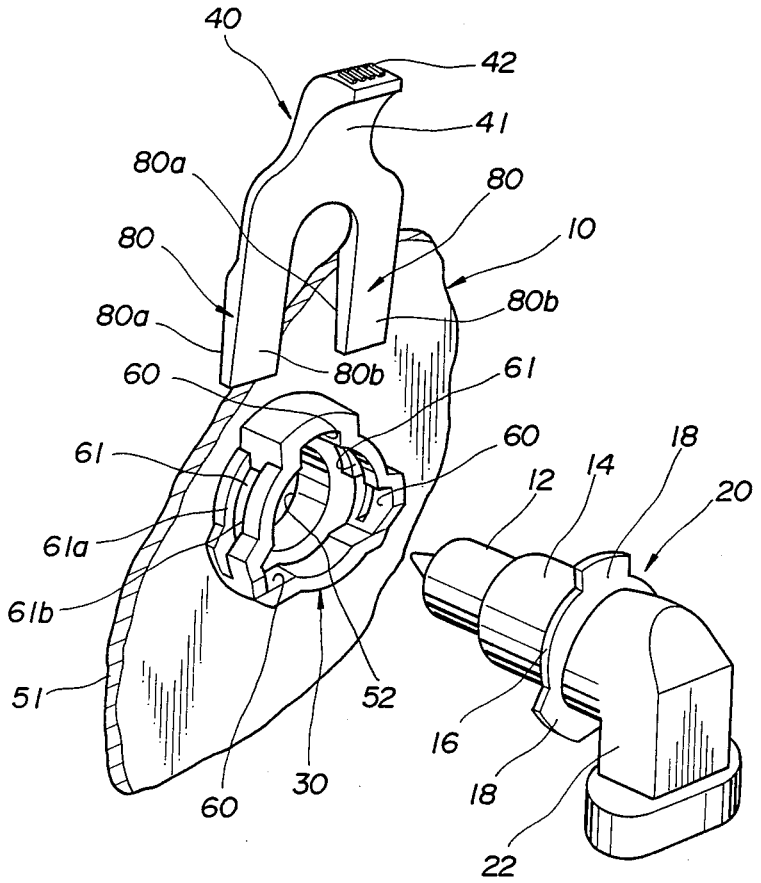

FIGS. 1 to 8 show a first embodiment of the lamp bulb assembly according to the present invention. The reference numeral 10 in FIG. 1 indicates a reflector to which a plug body 20 to which a base 14 holding a lamp bulb 12 is secured is detachably attached. The plug body 20 has provided thereon a radially extending flange 16 of which the outside diameter is larger than the inside diameter of an opening 52 formed in the apex of the reflector 10. The flange 16 has formed circumferentially thereon nearly at 0 o'clock, 4 o'clock and 8 o'clock positions, respectively, projections 18 extended radially from the flange. The reference numeral 22 indicates a connector formed integrally with the flange 16 and projected rearwardly taking an L shape, and which is connected to a power supply (not shown) which energizes filaments 13 in the lamp bulb 12 shown in FIG. 2.

Figure 4:
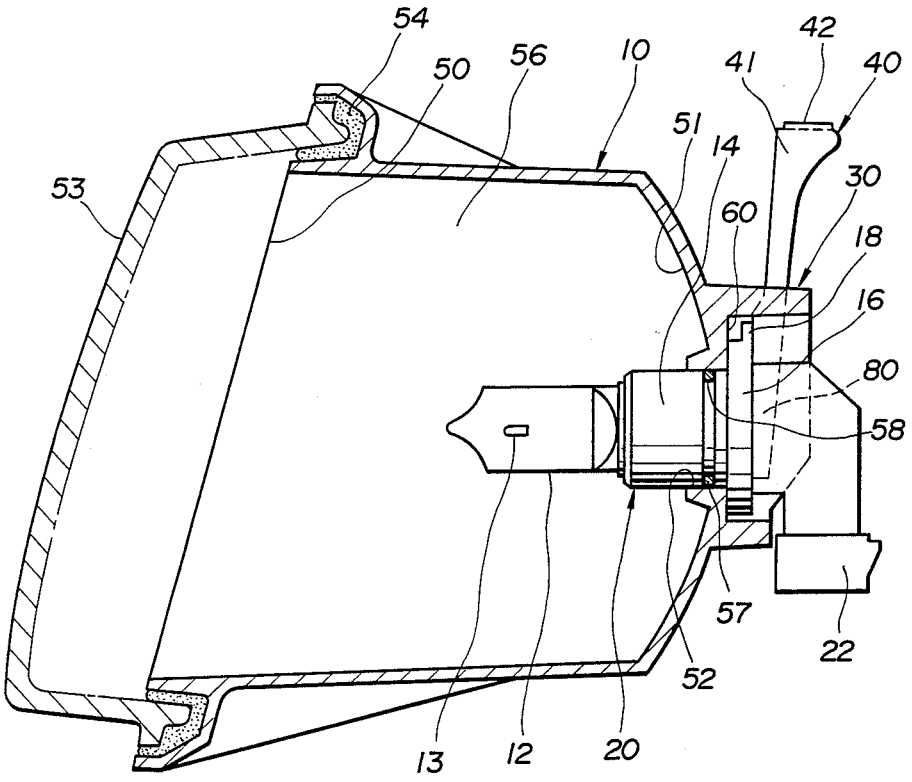

The reflector 10 is made of a metal or synthetic resin, and is open at the front 50 thereof as shown in FIG. 4. It has provided at the rear thereof a reflection surface 51 formed as paraboloid of revolution and also formed at the apex at the center of the reflection surface 51 an opening 52 through which the plug body is inserted. A lens 53 made of glass or synthetic resin is secured with an adhesive 54 or the like to the opening 50 at the front in such a manner as to cover the opening 50. There is formed at the rear of the reflector 10 a cylindrical socket 30 extending outwardly from the circumference of the opening 52, on the inner circumference of which there are formed axially extending recesses 60 nearly at the 0 o'clock, 4 o'clock and 8 o'clock positions corresponding to the projections 18 on the flange 16. When the plug body 20 is inserted into the socket 30, the outer circumference of the base 14 slides axially while in contact with the inner wall of the opening 52 and the three projections 18 on the flange 16 slide as guided in the three respective recesses 60 in the socket until the end faces adjoining the base 14 touch the outer circumference of the opening 52.

Figure 5:
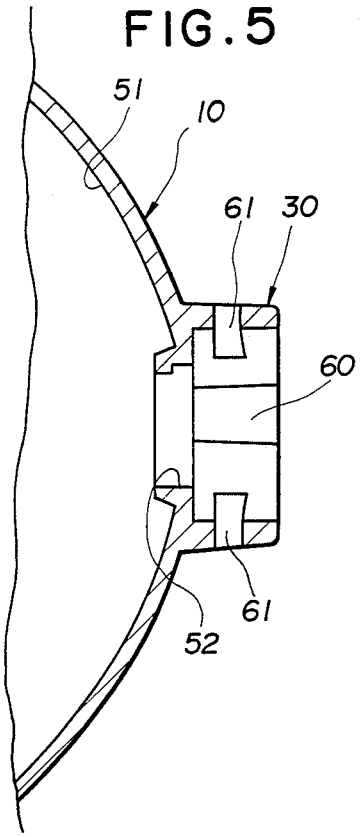
Figure 6:
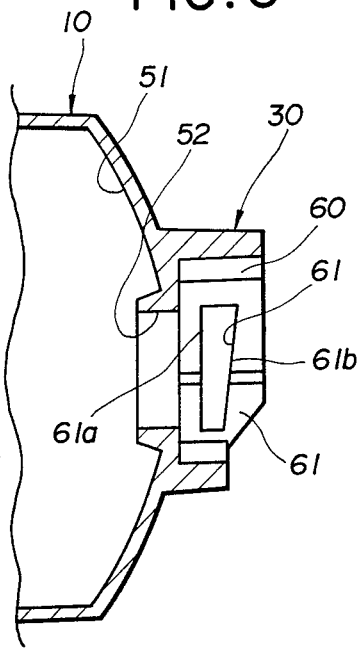
Figure 7:
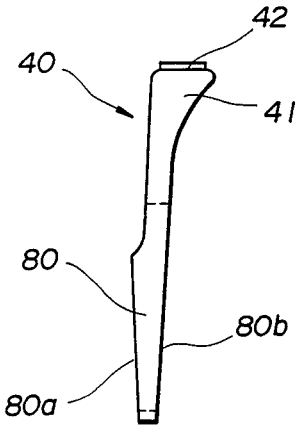
Figure 8:
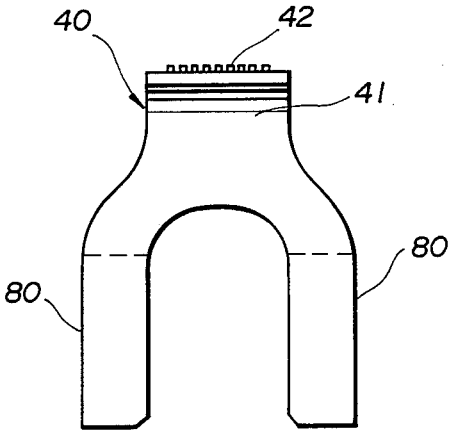
Figure 9:
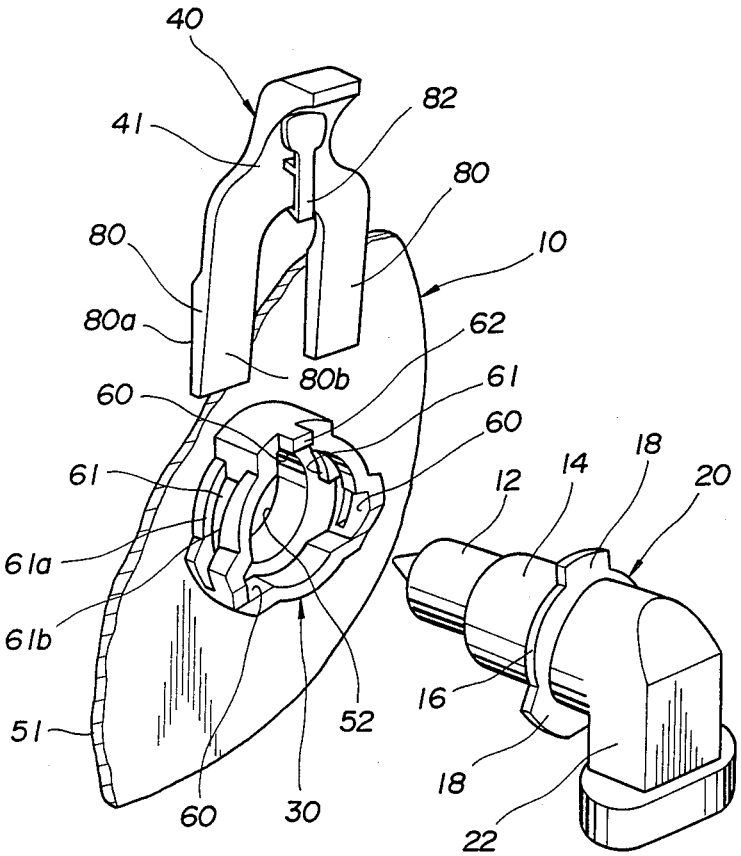
Figure 10:
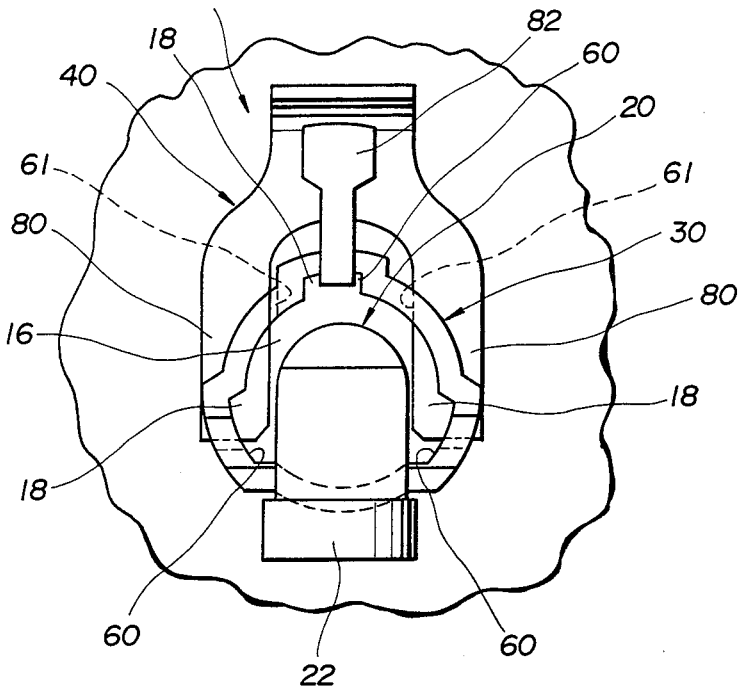

There are formed in the outer surfaces at two positions circumferentially from the 0 o'clock position toward the 4 o'clock and 8 o'clock positions, respectively, two slots 61 into which the two wedge-shaped portions 80, respectively, of a cleat 40, which will be described later, can be inserted. As shown in FIGS. 1 and 5, each of the slots 61 is so formed as to have an inner wall **61*a* perpendicular to the socket axis and an outer wall 61*b* slanted with respect to the inner wall 61*a*, these inner and outer walls being opposite to each other. That is, the slots 61** are so formed as to be narrower in the direction from the 0 o'clock position toward the 4 o'clock and 8 o'clock positions, respectively.

Figure 2:
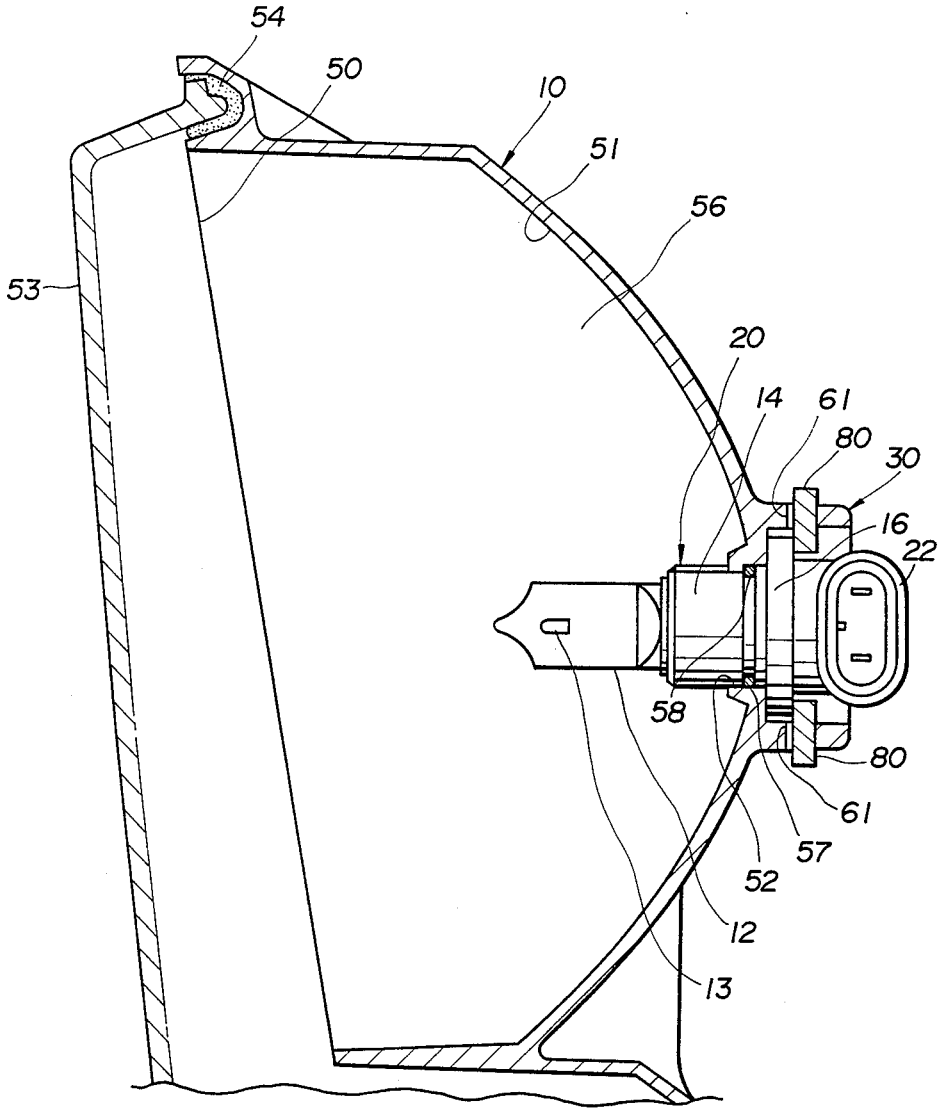
Figure 3:
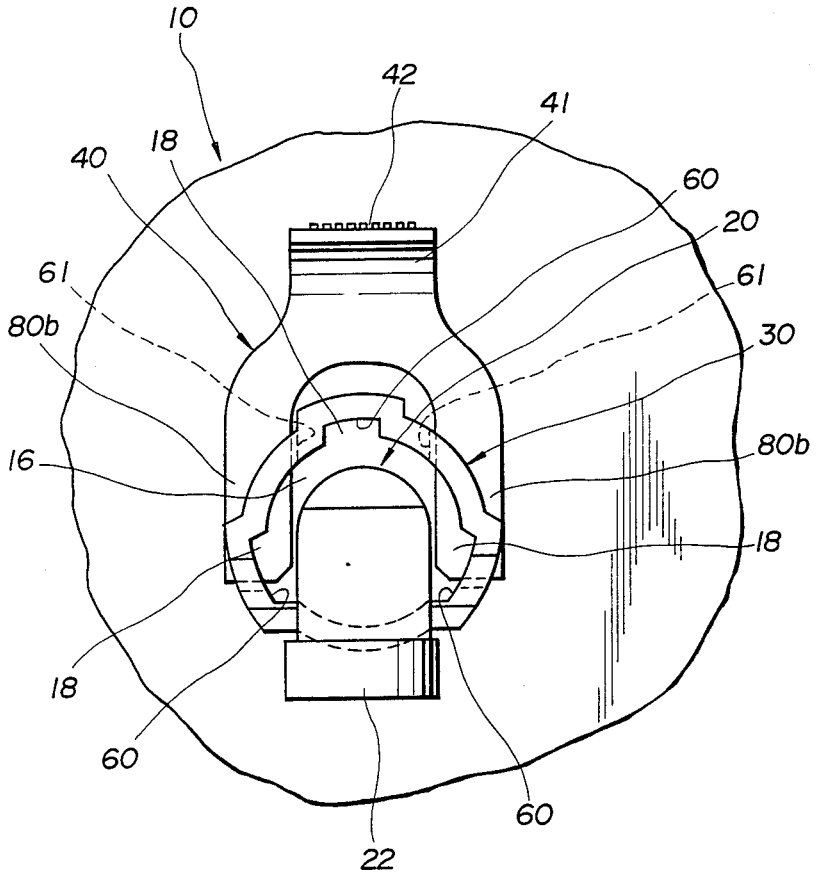

The two wedge-shaped portions 80 of the cleat 40 are formed like a fork bifurcated at a grip 41, and each has provided from the middle portion to the lower end thereof a front surface **80*a* perpendicular to the cleat axis and a rear surface 80*b* slanted with respect to the front surface 80*a*. The slant of the rear surface 80*b* is somewhat larger than that of the outer wall 61*b* of the slot 61 in the socket so that the spacing between the front and rear surfaces of the wedge-shaped portions 80, namely, the thickness of the wedge-shaped portions in the direction of the socket axis, is gradually smaller from the middle portion to the lower end. This thickness is selected to be somewhat smaller the spacing between the inner wall 61*a* and outer wall 61*b* of the slots 61 formed in the socket. When the plug body 20 is inserted in the socket 30 so that the end face of the flange 16 that is at the side of the base 14 is in contact with the outer circumference of the opening 52, the end face of the flange 16 that is at the side of the connector is somewhat nearer the outer wall 61*b* of the slot 61 than the inner wall 61*a* as shown in FIG. 2. When the cleat 40 is inserted into the slots 61, the front surfaces 80*a* of the wedge-shaped portions 80 are lowered while kept in contact with the end face of the flange 16 that is at the side of the connector and the slanted rear surfaces 80*b* of the wedge-shaped portions 80 are lowered while kept in contact with the slanted outer walls 61*b*, thereby pressing the flange 16 in the axial direction. The reference numeral 42 indicates nonslipping ribs useful in inserting into the slots 61 the cleat 40 as grasped at the grip 41 thereof. The reference numeral 57 indicates an O-ring disposed in an annular recess 58 formed in the outer circumference of the base 14 and which provides a sealing between the inner circumference of the opening 52 and the plug body 20 when inserted in the socket 30**.

The plug body 20 constructed as in the above description is attached to the socket 30 as follows:

First, the three projections 18 of the flange 16 are fitted into the respective recesses 60 in the socket 30, and then the plug body 20 is moved axially. The three projections 18 are axially guided through the recesses 60, respectively, and slid until the end face of the flange 16 that is at the side of the base 14 touches the outer circumference of the opening 52. Thus, the lamp bulb 12 is introduced through the opening 52 of the reflector 10 into the lamp room 56 and the O-ring 57 is positioned between the base 14 and the inner circumference of the opening 52. In this condition, the wedge-shaped portions 80 of the cleat 40 are inserted into the two slots 61 in the socket 30 from a direction perpendicular to the axis. Then, the front surfaces 80*a* of the wedge-shaped portions 80 are lowered while kept in contact with the end face of the flange 16 that is at the side of the connector 22, while the axially slanted rear surfaces 80*b* in contact with the outer walls 61*b* of the slots 61 are lowered while forcing outwardly the outer walls 61*b*. In a position shown in FIG. 3, the end face of the flange 16 that is at the side of the base 14 is forced to the outer circumference of the opening 52 and the plug body 20 is rigidly secured to the reflector 10.

The plug body 20 can be easily detached from the reflector 10 by pulling out the wedge-shaped portions 80 of the cleat 40 from the slots 61. It will be evident from the foregoing description that the lamp bulb assembly according to the present invention can be of a very simple structure and the plug body 20 can be easily attached to and detached from the reflector 10 because of the wedging between the wedge-shaped portions 80 of the cleat 40 and the slots 61 in the socket 30.

Figure 12:
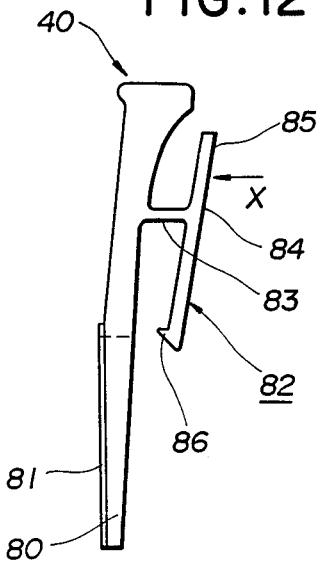
Figure 13:
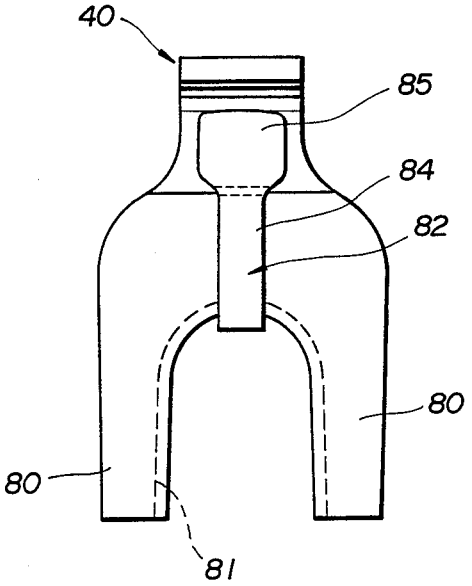
Figure 11:
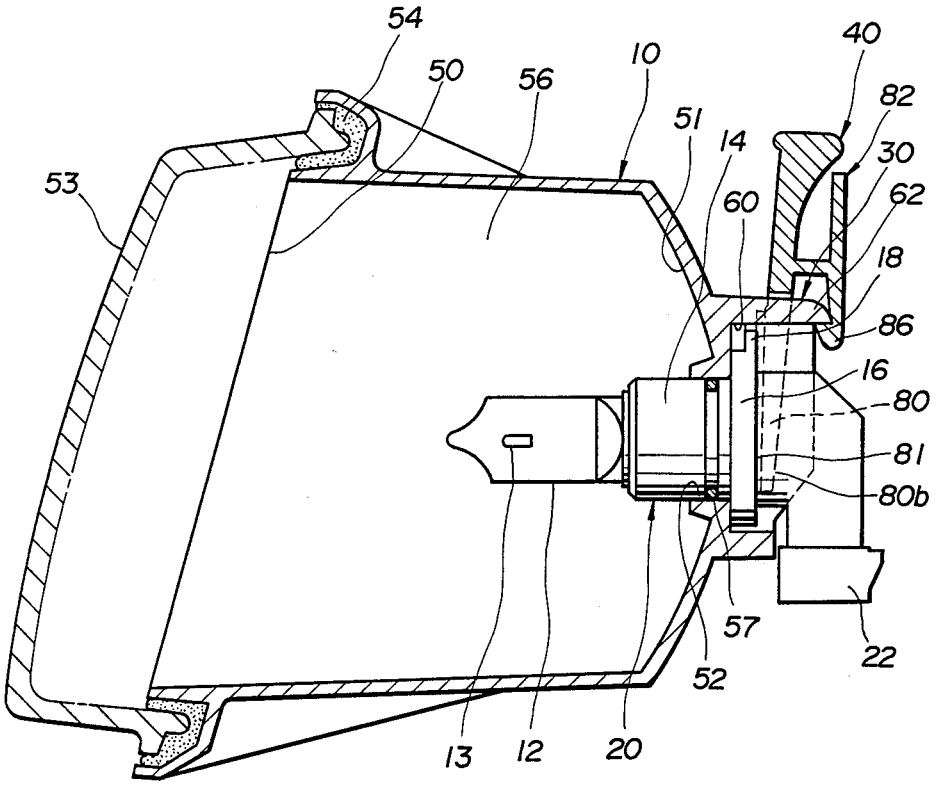

FIGS. 9 to 13 show a second embodiment of the lamp bulb assembly according to the present invention. In these Figures, the same or similar elements in the second embodiment as or to those in the first embodiment are indicated with the same reference numerals. According to this embodiment, a projection 81 is provided along the front inner edge of the wedge-shaped portions 80 of the cleat 40 as shown in FIG. 13. Further, the cleat 40 has integrally formed on the rear surface thereof a pawl member 82 made of a resilient materal and which is pivotable, and there is provided at the outer upper portion of the opening in the socket 30 a projection 62 on which the pawl member 82 can be engaged with the cleat 40 inserted into the slots 61 in the socket 30. Namely, the pawl member 82 consists of a horizontal portion 83 protruding generally horizontally from the cleat body 40 and which is integrally terminated by a vertical portion 84. This vertical portion 84 has a grip 85 at the upper end thereof and a pawl 86 at the lower end thereof. As shown in FIG. 12, the vertical portion 84 the pawl member 82 before the wedge-shaped portions 80 are inserted into the slots 61 is not 90 degrees against the horizontal portion 83 but slightly slanted. For securing the plug body 20 to the socket by inserting the cleat 40 into the slots 61, the cleat 40 is inserted into the slots 61 with the grip 85 pressed by the thumb in the direction of arrow X, namely, with the pawl 86 pivoted about the end of the horizontal portion 83 in the opposite direction to the direction of arrow X, and thereafter when the hand is released from the pawl member 82, the pawl 86 resiliently returns to its initial position and engages on the projection 62 on the socket 30. The pawl member 82 is formed as a locking means of preventing the cleat 40 from coming off from the slots 61 in the socket 30 due to any vibration. For replacement of the lamp bulb 12, when the grip 85 is pressed by the thumb in the direction of arrow X, the pawl 86 is disengaged from the projection 62, so that the cleat 40 can be easily pulled out of the slots 61. When the cleat 40 is inserted into the slots 61, the above-mentioned projection 81 formed along the inner edge on the front surface 80*a* of the wedge-shaped portions 80 of the cleat 40 is lowered while kept in contact with the end face of the flange 16 that is at the side of the connector 22, while the rear surfaces 80*b* of the wedge-shaped portions 80 that are slanted with respect to the axis are lowered while forcing the outer walls 61*b* of the slots 61 outwardly. When the wedge-shaped portions 80 are fully inserted, the front surfaces 80*a* thereof are in contact, only at the projection 81 thereof, with the end face of the flange 16 as shown in FIG. 11. As having been previously described, the front surface 80*a* in the first embodiment is in plane contact with the end face of the flange 16, while in this second embodiment, the front surface is in substantially linear contact with the end face in a limited area. Therefore, according to the second embodiment, it is not necessary to form perpendicularly to the axis all the portions of the front surface 80*a* that are in contact with the end face of the flange 16 and so the machining precision in the manufacturing process needs not be so high.

Figure 14:
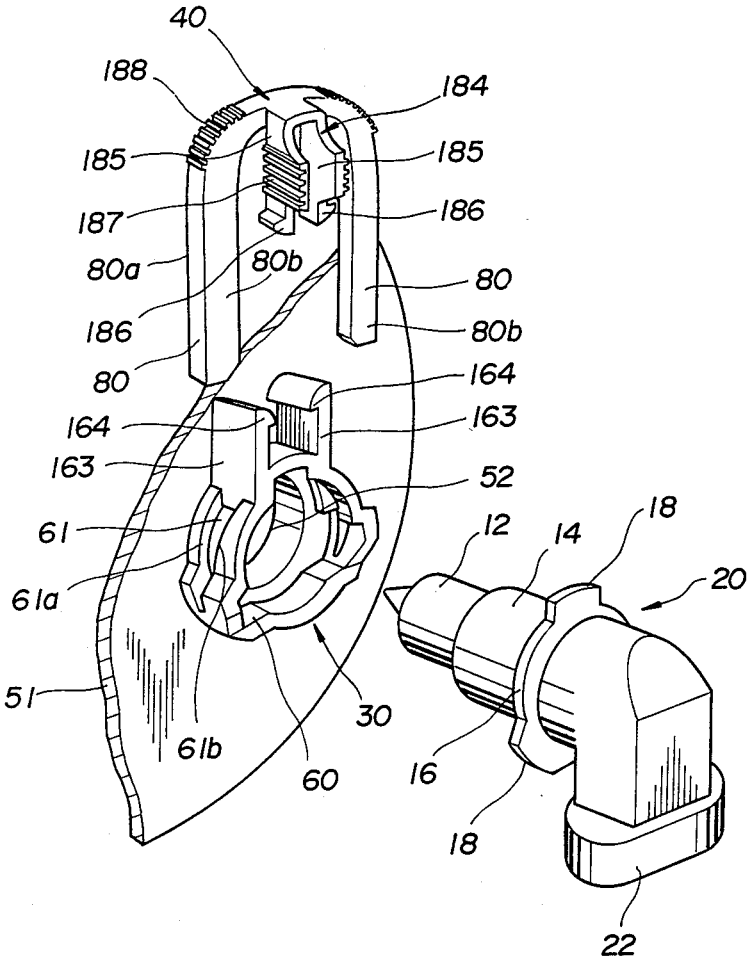
Figure 15:
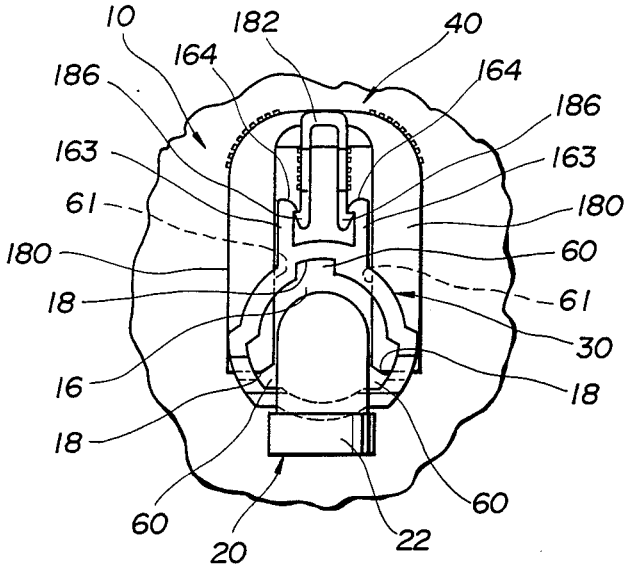
Figure 16:
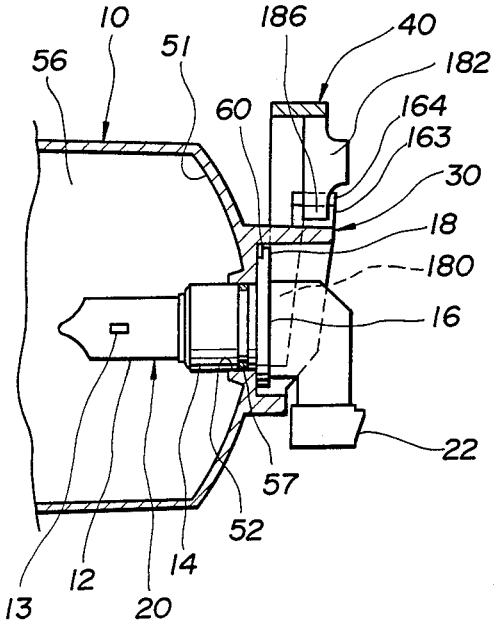

FIGS. 14 to 16 show the third embodiment of the lamp bulb assembly according to the present invention. In these Figures, the same or similar elements as or to those in the first embodiment are indicated with the same reference numerals. In this third embodiment, the cleat 40 is formed nearly in the U shape and has wedge-shaped portions 80 on the respective legs thereof from the central portions toward the lower ends. Each of the wedge-shaped portions 80 is defined by the surface 80*a* perpendiculer to the axis and the surface 80*b* slightly slanted with respect to the surface 80*a*, which is similar to the first embodiment. Further, there is integrally formed on the upper central portion of the cleat 40 at the outer lateral surface thereof a generally inverted U-shaped member 184 having a pair of walls 185 downwardly and a pair of outwardly protruding pawls 186 formed at the lower end of each wall 185. Likewise, there is formed at the upper outer circumference of the socket 30 a pair of upwardly extending walls 163 in a position where one of the recesses 60 is between the walls 163. These walls 163 have at the upper ends of the inner walls thereof a pair of pawls 164 corresponding to the pair of pawls 186 of the above-mentioned inverted U-shaped members 184. The portion from the end of the pawl 186 to the lower end of the wall 185 is formed as curved downwardly, and the portion from the end of the pawl 164 to the upper end of the wall 163 is formed as curved upwardly. Normally, the pair of walls 185 are slightly opened horizontally, but as the wedge-shaped portions 80 of the cleat 40 are inserted into the slots 61, the upwardly curved surfaces formed on the pawls 164 are guided by the downwardly curved surfaces formed on the pawls 186 so that the walls 185 are gradually closed horizontally. When the cleat 40 is fully inserted into the slots 61, the pawls 186 are engaged with the pawls 164 to prevent the cleat 40 from resiliently returning to its initial condition. Thus, the inverted U-shaped member 184 and pawls 164 form together a mechanism which locks the cleat 40 to the socket 30. The reference numerals 187 and 188 indicate nonslipping knurlings formed on the inverted U-shaped member 184 and the upper portions of the cleat 40, respectively; the knurlings 187 is useful for making the walls 185 be closed horizontally to each other, and the knurlings 188 are effectively usable for inserting the cleat 40 into the slots 61.

Figure 17:
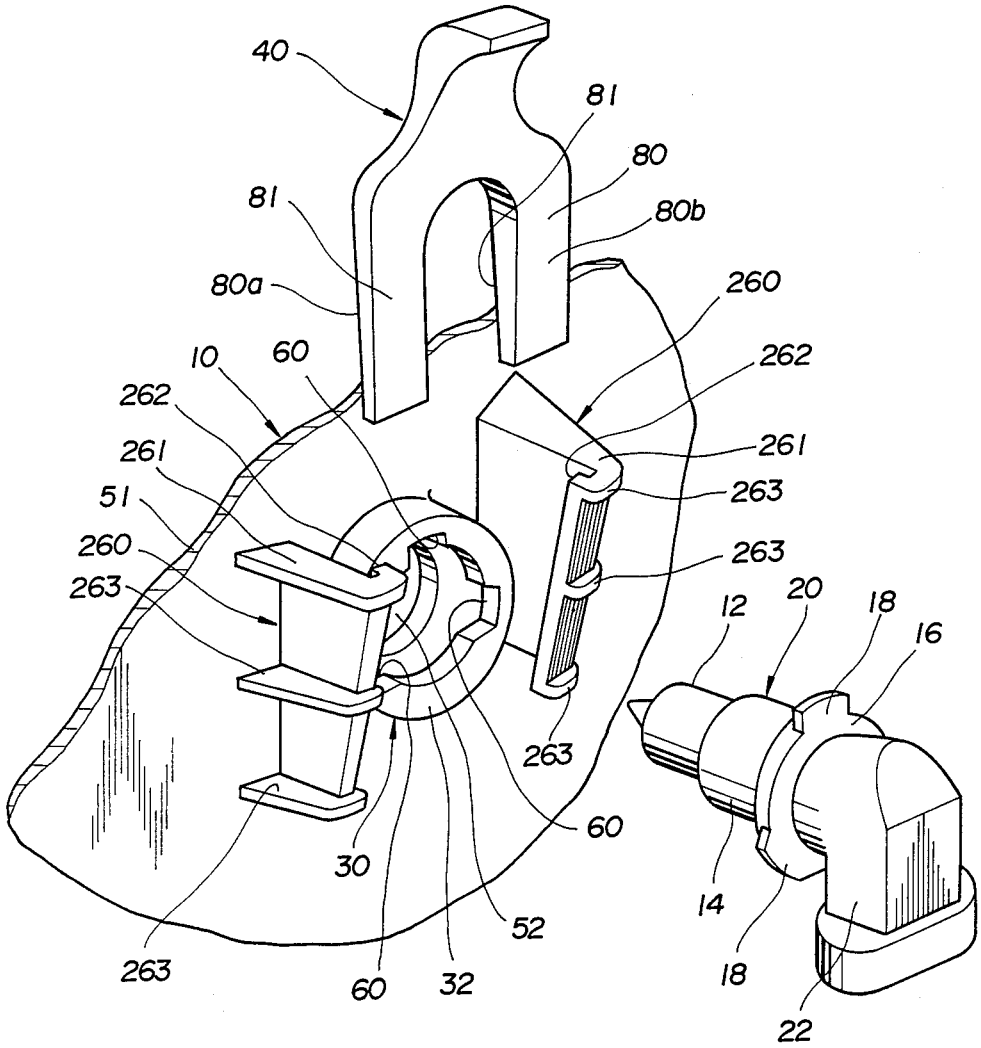
Figure 18:
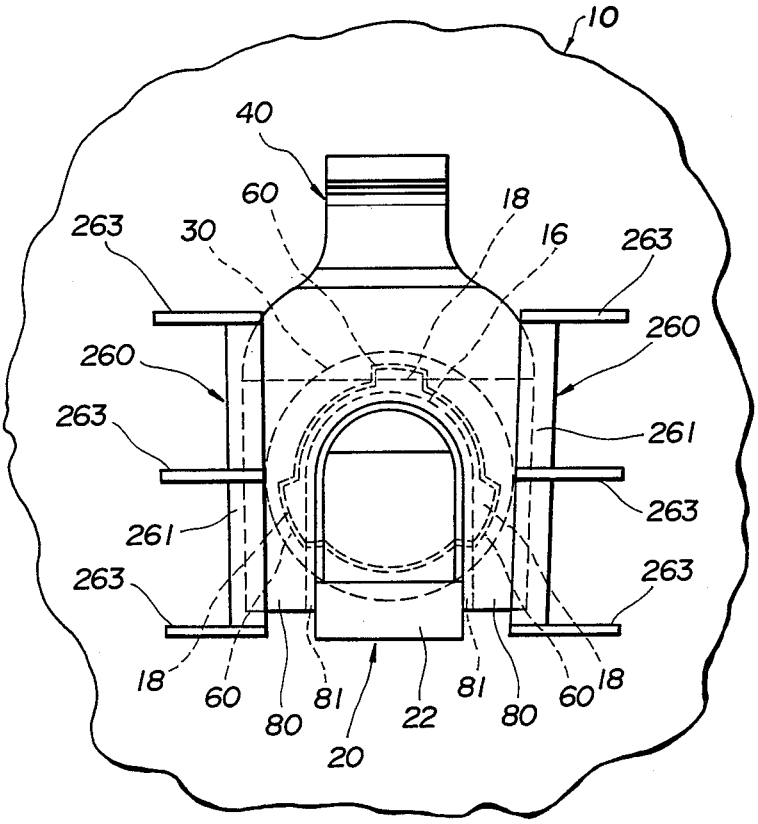
Figure 19:
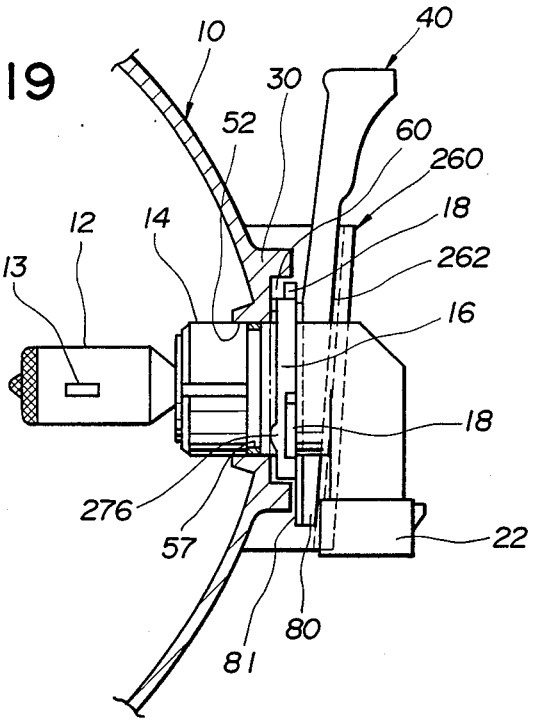
Figure 20:
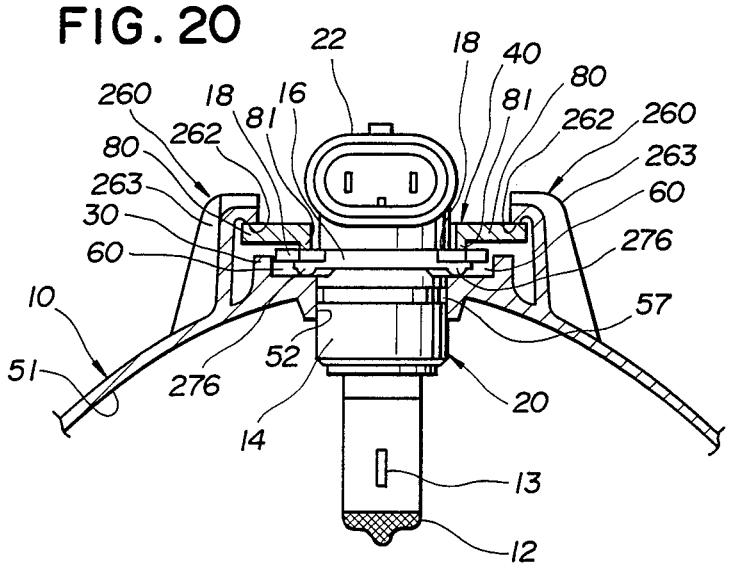
Figure 21:
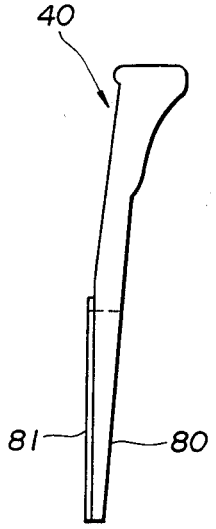
Figure 22:
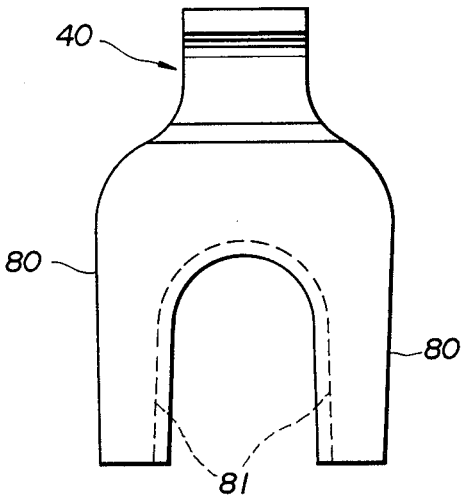

FIGS. 17 to 22 show a fourth embodiment of the lamp bulb assembly according to the present invention. The same or similar elements in this fourth embodiment as or to those in the first embodiment are indicated with the same reference numerals. In this embodiment, the slots into which the cleat 40 is to be inserted are not formed in the socket 30, but a pair of guide members 260 is provided, as shown in FIG. 17, on the rear of the reflector 10 in positions where the socket 30 is between the guide members 260. Each of the guide members 260 consists of a wall 261 having a hook-shaped section and which has at the upper, middle and lower portions thereof reinforcement ribs 263 parallel to one another. Each of the guide members 260 has provided at the end thereof a slanted wall 262 corresponding to the wedge-shaped portion 80 of the cleat 40 so that the spacing between the slanted wall and the end face 32 of the socket 30 is gradually narrower from the upper to lower portion of the slanted wall. With the plug body 20 inserted into the socket 30, the cleat 40 is introduced from a direction perpendicular to the axis between the end face of the flange 16 that is at the side of the connector and the slanted wall 262 of the guide member 260. There are formed on the end face of the flange 16, that is at the side of the base, projections 276 in positions, respectively, on the end face of correspondingly to the projections 18, respectively, as shown in FIGS. 19 and 20. When the base 14 of the plug body 20 is fully inserted into the socket 30 while kept in contact with the inner circumference of the opening 52, the projections 276 are in contact, at three points, with the circumference of the opening 52. The thickness of the flange 16 is so determined that at this time the end face of the flange 16 that is at the side of the base protrudes somewhat outwardly from the opening end 32 of the socket 30. As shown in FIGS. 21 and 22, the cleat 40 has provided a projection 81 along the front inner edge of the wedge-shaped member portion 80 thereof as in the second embodiment. When the cleat 40 is inserted from a direction perpendicular to the axis with the plug body 20 fully inserted in the socket 30, the projection 81 provided on the inner surface **80*a* of the wedge-shaped portion 80 is lowered while kept in linear contact with the end face of the flange 16 that is at the side of the connector, while the outer surface of each wedge-shaped portion 80, namely, the slanted surface 80*b* is lowered along the slanted surface 262 of each guide member 262, whereby each slanted surface 262 is forced outwardly under the wedging action of the slanted surface 80*b*. Therefore, while the three projections 276 formed on the inner end face of the flange 16 are in contact with the opening end 32 of the socket 32, the flange 16 is axially pressed so that the plug body 20 in which the lamp bulb 12 is secured is rigidly secured to the socket 30. Also, the plug body 20 can be easily pulled out from the socket 30 by extracting the cleat 40 from the guide members 260**.

Figure 23:
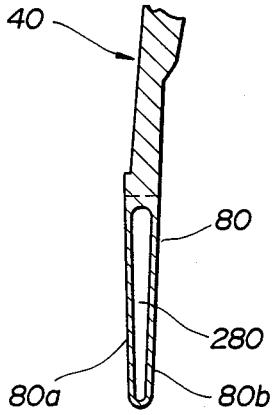
FIGS. 23 and 24 are sectional views of the essential portion of each of the variants of cleat wedge-shaped portions.
Figure 24:
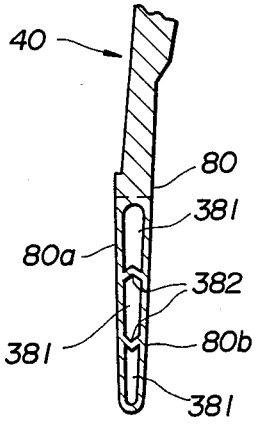

FIGS. 23 and 24 show variants of cleat which can be effectively applicable especially to the first and second embodiments. Each wedge-shaped portion 80 of the cleat 40 shown in FIG. 23 has formed therein a hollow portion 280 communicating with both lateral sides, and each wedge-shaped portion 80 of the cleat 40 shown in FIG. 24 has also formed therein three hollow portions 381 communicating with both lateral sides and which are separated from each other by partitions 382. Owing to the hollow portion 380 or hollow portions 381 in the wedge-shaped portion 80, the latter is deformed when externally forced so that any dimensional nonuniformity of elements can be accomodated, thereby permitting to positively secure to the reflector 10 the plug body 20 in which the lamp bulb 12 is secured.

What is claimed is:

1. A lamp bulb assembly, comprising:

a reflector having an apex and an opening in the apex;

a socket taking a substantially cylindrical form and which has an opening extending outwardly from the back of said socket and opened outwardly;

a plug body so formed as to be inserted into said socket from the axial direction and in which a lamp bulb as light source is secured, said plug body having formed on the outer circumferential surface thereof a flange which can be axially moved while in contact with the inner surface of said socket, said flange being in contact, at one end face thereof, with the outer circumferential edge of the opening in said reflector while the other end face is positioned outside the opening in said socket, when said plug body is fully inserted in said socket;

a cleat having wedge-shaped portions of which one surface is substantially parallel to the other end face of said flange and the other surface is slanted with respect to said first surface;

guide members formed on the back of said reflector to position said wedge-shaped portions outside the opening in said socket and which have guide surfaces provided correspondingly to said other surface of said wedge-shaped portions;

said cleat being inserted from a direction substantially perpendicular to said axial direction between said other surface of said flange and guide surfaces of said guide members, when said plug body is fully inserted in said socket, so that owing to the wedging action of said other surfaces of said wedge-shaped portions onto said guide surfaces of said guide members, said flange is axially pressed.

2. A lamp bulb assembly according to claim 1, in which said guide members are formed integrally with said socket outside the opening in said socket and opposite walls of slots formed circumferentially in the outer surface of said socket act as said guide surfaces.

3. A lamp bulb assembly according to claim 1, in which said flange is axially movable along guide recesses axially formed in the inner circumferential surface of said socket.

4. A lamp bulb assembly according to claim 3, in which said guide recesses are circumferentially disposed at three positions as substantially regularly spaced from one another.

5. A lamp bulb assembly according to claim 2, in which said cleat is formed having two wedge-shaped portions and said slots are formed at two positions corresponding to said wedge-shaped portions.

6. A lamp bulb assembly according to claim 5, in which said cleat is provided with a pawl member made of a resilient material and which are tiltable and said socket has projections corresponding to positions where said cleat is inserted and which are engageable with said pawl member, said pawl member and projections forming together a means of locking said cleat.

7. A lamp bulb assembly according to claim 6, in which said pawl member is so disposed as to be tiltable in a plane parallel to said axial direction and said projections are disposed as protruded in a direction parallel to said axial direction.

8. A lamp bulb assembly according to claim 6, in which said pawl member has two pawls tiltable in a plane substantially perpendicular to said axial direction and said socket has formed thereon, at two positions corresponding to the positions where said cleat is inserted, projections engageable with said two pawls, respectively.

9. A lamp bulb assembly according to claim 1, in which said wedge-shaped portions have formed therein a hollow portion or portions communicating with both lateral sides thereof.

* * * * *